US008437444B2

(12) United States Patent
Pennington et al.

(10) Patent No.: US 8,437,444 B2
(45) Date of Patent: May 7, 2013

(54) APPARATUS AND METHODS FOR ACHIEVING REDUNDANT CONFINEMENT SEALING OF A SPENT NUCLEAR FUEL CANISTER

(75) Inventors: Charles W. Pennington, Alpharetta, GA (US); George Carver, Norcross, GA (US)

(73) Assignee: NAC International, Inc., Norcross, GA (US)

( * ) Notice: Subject to any disclaimer, the term of this patent is extended or adjusted under 35 U.S.C. 154(b) by 1589 days.

(21) Appl. No.: 11/034,622

(22) Filed: Jan. 13, 2005

(65) Prior Publication Data

US 2006/0171500 A1 Aug. 3, 2006

(51) Int. Cl.
*G21C 13/00* (2006.01)
*G21C 19/00* (2006.01)

(52) U.S. Cl.
USPC ..... 376/203; 250/506.1; 376/272

(58) Field of Classification Search ..... 376/272; 250/506.1, 507.1
See application file for complete search history.

(56) References Cited

U.S. PATENT DOCUMENTS 1,906,010 A * 4/1933 Naylor ..... 138/154
3,275,736 A * 9/1966 Hotine et al. ..... 174/84 R
4,187,410 A * 2/1980 Eroshkin et al. ..... 219/137.2
4,596,688 A * 6/1986 Popp ..... 376/272
4,633,091 A * 12/1986 Kurasch et al. ..... 250/506.1
4,666,659 A * 5/1987 Lusk et al. ..... 376/272
4,781,883 A * 11/1988 Daugherty et al. ..... 376/272
4,896,046 A * 1/1990 Efferding ..... 250/507.1
4,997,618 A * 3/1991 Efferding ..... 376/272
5,513,232 A * 4/1996 Jones et al. ..... 376/272
5,546,436 A * 8/1996 Jones et al. ..... 376/272
5,567,952 A * 10/1996 Kirchner et al. ..... 250/506.1
5,651,038 A * 7/1997 Chechelnitsky et al. ..... 376/272
5,898,747 A * 4/1999 Singh ..... 376/272
6,064,710 A * 5/2000 Singh ..... 376/272
6,538,259 B2 * 3/2003 Matsunaga et al. ..... 250/506.1
6,625,246 B1 * 9/2003 Singh et al. ..... 376/261
6,727,510 B2 * 4/2004 Matsunaga et al. ..... 250/496.1
6,823,034 B1 * 11/2004 Doman ..... 376/272
6,898,258 B2 * 5/2005 Ohsono et al. ..... 376/272
6,919,534 B2 * 7/2005 Komai et al. ..... 219/137 R
2003/0218056 A1 * 11/2003 Fairchild et al. ..... 228/175

OTHER PUBLICATIONS

Charles Hayes. "The ABC's of Nondestructive Weld Examination." NDTnet Jun. 1998, vol. 3. No. 6. <http://www.ndt.net/article/0695/hayes/hayes.htm> downloaded Sep. 18, 2006.*

* cited by examiner

*Primary Examiner* — Johannes P Mondt
(74) *Attorney, Agent, or Firm* — Thomas|Horstemeyer, LLP

(57) ABSTRACT

Disclosed are the apparatus and methods for closing a canister that stores and transports spent nuclear fuel. In one embodiment, the canister includes a canister shell that includes an open end. A closure lid is inserted within the open end of the canister shell. The closure lid engages the open end of the canister shell to provide a weld area that is substantially on the outer circumference of the closure lid. The weld area includes a first weld layer and a second weld layer. The first weld layer welds the closure lid to the canister shell at the weld area and closes the canister. The second weld layer also welds the closure lid to the canister shell at the weld area, providing a redundant closure seal, and is disposed substantially on top of the first weld layer. The method for closing the canister is provided herein.

9 Claims, 5 Drawing Sheets

APPARATUS AND METHODS FOR ACHIEVING REDUNDANT CONFINEMENT SEALING OF A SPENT NUCLEAR FUEL CANISTER

TECHNICAL FIELD

The present invention relates to a canister that stores and transports spent nuclear fuel, and more importantly, the embodiments relate to the apparatus and methods for achieving redundant confinement sealing of a canister.

BACKGROUND OF THE DISCLOSURE

Dry nuclear spent fuel storage technology is deployed throughout the world to expand the capabilities of nuclear power plants to discharge and store spent fuel, thereby extending the operating lives of the power plants. Two fundamental classes of technology are used in dry spent fuel storage: metal casks with final closure lids that are bolted closed at the power plants after loading with spent fuel, and concrete storage casks containing metal canisters having canister final closure lids that are welded closed at the power plants following spent fuel loading. This latter technology is referred to as canister-based dry spent fuel storage technology.

Canister-based dry spent fuel storage technology designs typically comply with federal regulatory requirements, among which are requirements pertaining to confinement, sealing, inspection, and evaluation or testing. In particular, the Code of Federal Regulations (CFR) requires that "[t]he spent fuel storage cask must be designed to provide redundant sealing of confinement systems." See 10CFR72.236(e). The confinement system is defined in 10CFR72.3, as follows: "Confinement systems means those systems, including ventilation, that act as barriers between areas containing radioactive substances and the environment." In other words, the confinement system is the boundary that is to be protected to assure that there is no release to the environment of the contained radioactive materials within the spent fuel dry storage system.

The Nuclear Regulatory Commission (NRC), which enforces compliance with federal regulations, has applied the above requirements to fabrication facility-installed, confinement system welds in canister-based dry storage designs (those which are performed prior to delivery to the power plant and prior to loading with spent fuel) such that single or multi-pass welds that are inspected with NRC approved inspection methods and techniques meet the requirements of 10CFR72.236(e). However, for final closure welds on canister-based technology, which are conducted at nuclear facilities following loading of spent fuel, the application of the regulatory requirements has varied, but NRC approval of the varied approaches has been consistent with the use of approved single or multi-pass welding approaches followed by the application of approved inspection methods and techniques.

Over the years, most canister-based dry storage designs have followed a path to assure compliance with redundant sealing requirements for the final canister closure at the power plant (the "field closure") by the use of redundant lids for the final closure design. That is, two lids or closures were placed within the canister and welded to the canister shell. These lids were not required to be structurally separate (independent) and could be linked to each other by additional welding. However, approaches with and without structural independence of the redundant lids have all been approved by the NRC for compliance with federal requirements.

The use of a redundant lid approach on canister-based designs leads to lid handling and installation complexities at power plants. With multiple lid handling operations, opportunities for operator injury and equipment damage are increased, and more time must be spent in higher radiation fields. Further, the use of redundant lids increases the radiation exposure of power plant personnel when compared to a single lid approach, since more time is required to handle, lift, install and weld two lids, because the first lid to be welded of a redundant lid design provides less radiation shielding to the operators, and, therefore, more radiation exposure. Such an approach may be at variance with federal regulatory requirements, if there is a reasonable alternative that reduces direct radiation levels, to wit: "Operational restrictions must be established to meet as low as reasonably achievable [known as ALARA in industry parlance, a design objective to keep operator radiation exposures reasonably low] objectives for radioactive materials in effluents and direct radiation levels associated with ISFSI or MRS operations." (See 10CFR72.104(b).)

Thus, a heretofore unaddressed need exists in the industry to improve upon the aforementioned deficiencies and inadequacies.

SUMMARY OF THE DISCLOSURE

Disclosed are the apparatus and methods for closing a canister that stores and transports spent nuclear fuel.

In one embodiment, a method for closing a canister includes providing a canister shell that includes an open end and providing a weld area that is substantially on the outer circumference of the closure lid where the closure lid engages the open end of the canister shell. The method further includes welding the closure lid to the canister shell at the weld area that forms a first weld layer to close the canister and welding the closure lid to the canister shell at the weld area that forms a second weld layer substantially on top of the first weld layer to close the canister.

As a further option, the method can further include welding of the closure lid to the canister shell at the weld area to form additional redundant weld layers and close the canister to assure that the composite weld layer depth and/or the number of redundant seal weld layers is achieved. As another further option, the method includes disposing a seal ring substantially above a preceding weld layer and between the canister shell and the closure lid. The method includes cooling the first, second and additional weld layers below the material-specific adhesion temperature after each layer is applied to assure the weld layers have achieved adhesion characteristics with the canister shell and closure lid, and inspecting the first, second and additional weld layers after each layer is cooled using approved methods and techniques, for example, dye-penetrant examination of the weld, to determine the quality of the weld layers and their acceptability.

In one embodiment, the canister includes a canister shell that includes an open end and a basket assembly that is disposed in the canister shell. A closure lid is inserted within the open end of the canister shell. The closure lid engages the open end of the canister shell to provide a weld area that is in the proximity of the outer circumference of the closure lid. The weld area includes a first weld layer and a second weld layer. The first weld layer welds the closure lid to the canister shell at the weld area and closes the canister. The second weld layer also welds the closure lid to the canister shell at the weld area, providing a redundant closure seal, and is disposed substantially on top of the first weld layer.

As a further option, the canister can include additional redundant weld layers that weld the closure lid to the canister shell at the weld area and that close the canister to assure that the composite weld layer depth and/or the number of redundant seal weld layers is achieved. As another further option, a seal ring is disposed substantially above a preceding weld layer and between the canister shell and the closure lid. The seal ring is welded to the closure lid and to the canister shell, providing another level of redundant closure sealing.

Other apparatus, methods, features, and advantages of the present invention will be or become apparent to one with skill in the art upon examination of the following drawings and detailed description. It is intended that all such additional apparatus, methods, features, and advantages be included within this description, be within the scope of the present invention, and be protected by the accompanying claims.

BRIEF DESCRIPTION OF THE DRAWINGS

The disclosed systems, apparatuses, and methods can be better understood with reference to the following drawings. The components in the drawings are not necessarily to scale.

DETAILED DESCRIPTION OF THE PREFERRED EMBODIMENT

Disclosed are apparatus and methods for a canister that stores and transports spent nuclear fuel. In one embodiment, the canister includes a weld area that includes a first weld layer and a second weld layer. The first weld layer welds a closure lid to a canister shell at the weld area and closes the canister. The second weld layer also welds the closure lid to the canister shell at the weld area, providing a redundant closure seal, and is disposed substantially on top of the first weld layer. As a further option, additional weld layers can be welded at the weld area to close the canister. As another further option, the canister can include a seal ring that is disposed substantially above a preceding weld layer and between the canister shell and the closure lid. The seal ring is welded to the closure lid and to the canister shell. The disclosed process assures that the closure lid is sealed to be leak tight. Example apparatuses are first discussed with reference to the figures. Although the apparatuses are described in detail, they are provided for purposes of illustration only and various modifications are feasible. After the exemplary apparatuses have been described, examples of methods of closing the canister are provided.

Figure 1:
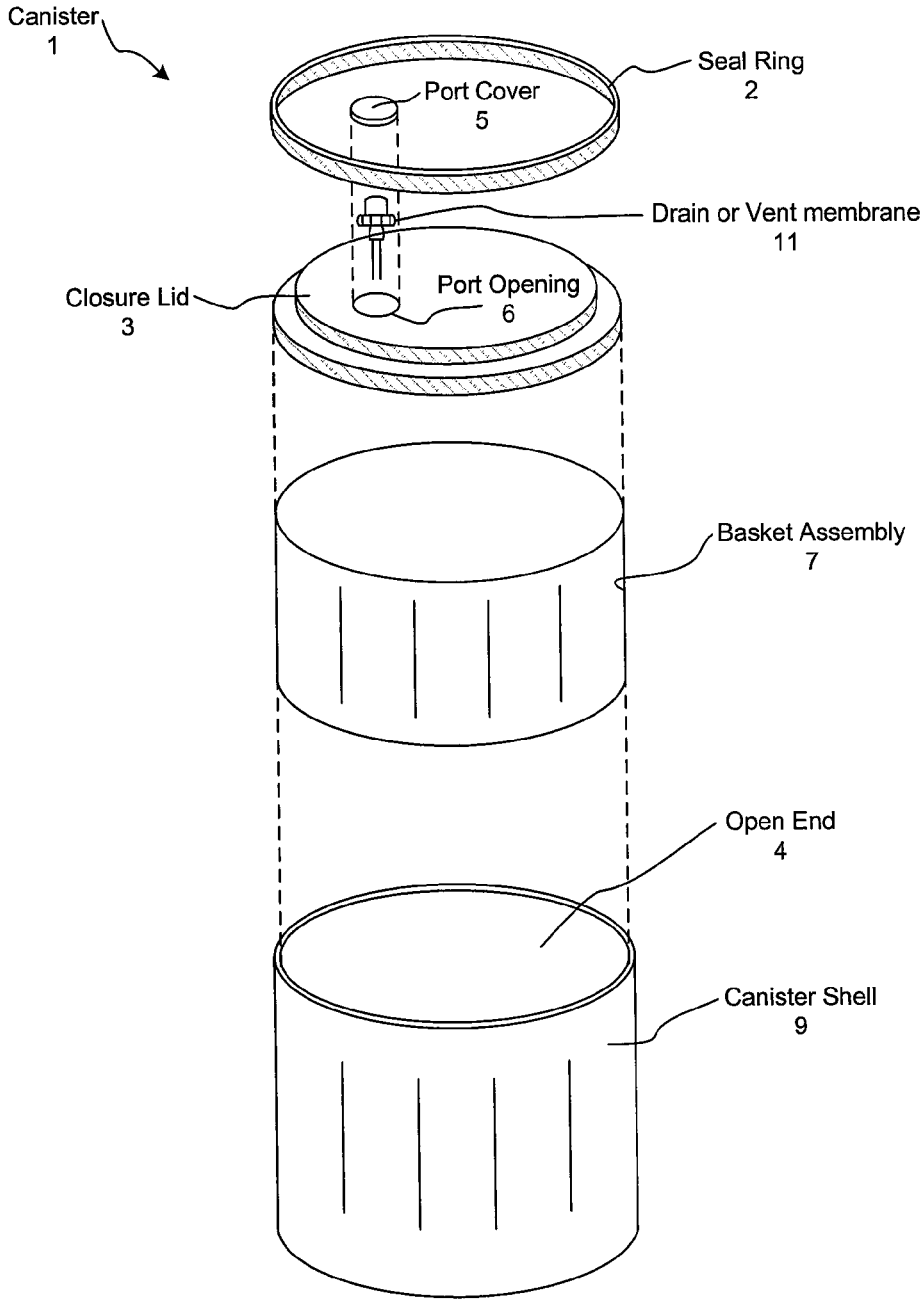
FIG. 1 is a partially cut-away, perspective view of an embodiment of a canister that stores and transports nuclear spent fuel.

Referring now in more detail to the figures in which like reference numerals identify corresponding parts, FIG. 1 is a partially cut-away, perspective view of an embodiment of a canister that stores and transports nuclear spent fuel. The canister 1 is a single closure lid design of a canister-based dry storage technology. The canister 1 includes one closure lid 3 and one weld area 8 (shown in FIG. 2). The use of a single closure lid design is one approach to achieving redundant sealing of the confinement system for "field closure" of the canister 1 following loading with spent fuel or other desired content. The canister 1 includes a canister shell 9 that includes an open end 4. In an alternative embodiment, the closure lid 3 can include a port opening 6 that is adapted to receive a port cover 5 and a drain or vent member 11. In an alternative embodiment, the canister 1 can include a basket assembly 7 that is preferably disposed in the canister shell 9 before the canister is sealed. In an alternative embodiment, the canister 1 can further include a seal ring 2 that is disposed between the canister shell 9 and the closure lid 3, at the inner circumference of the canister shell 9 and at the outer circumference of the closure lid 3. The seal ring 2 can be a single piece or multiple pieces.

Figure 2:
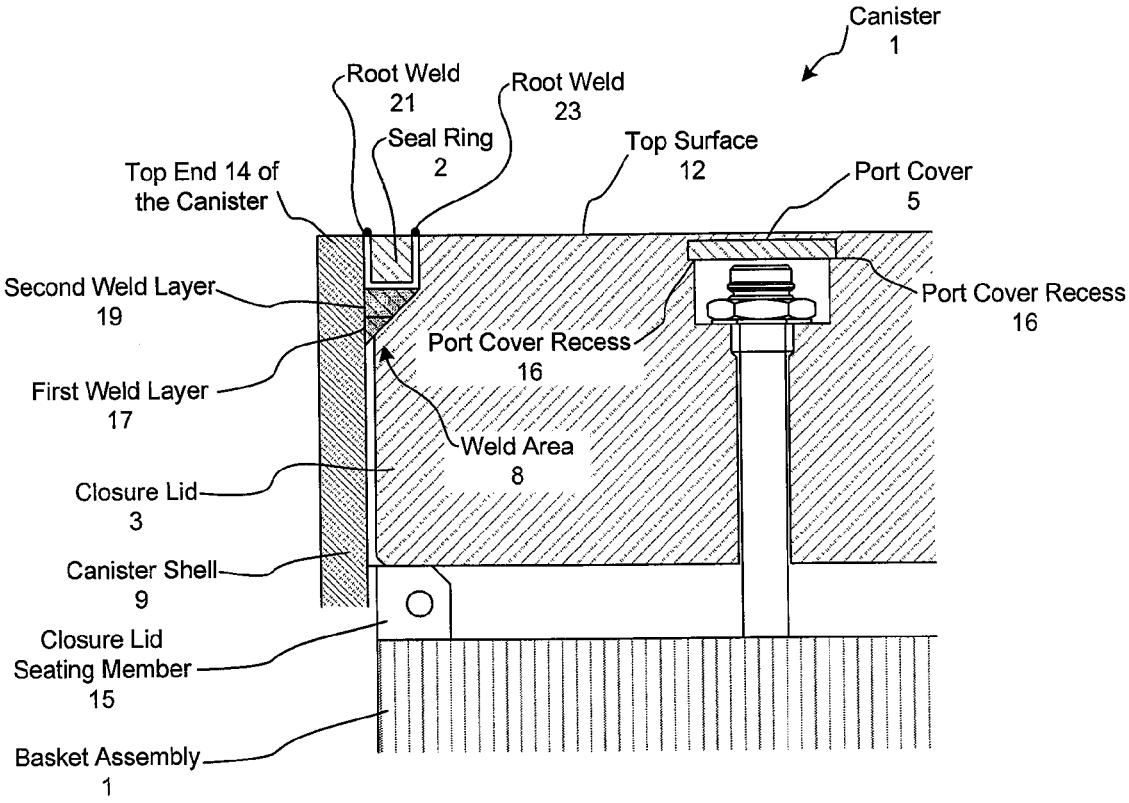
FIG. 2 is a partially cut-away, cross-sectional, side view of an embodiment of the canister shown in FIG. 1.

FIG. 2 is a partially cut-away, cross-sectional, side view of an embodiment of the canister shown in FIG. 1 that includes a redundant seal for regulatory compliance. The canister shell 9 of the canister 1 includes a closure lid seating member 15 that can be integrally coupled to the canister shell. The canister 1 is adapted to be inserted with a closure lid 3 that rests on the closure lid seating member 15 of the canister 1 such that the top surface 12 of the closure lid 3 is substantially parallel to the top end 14 of the basket assembly 7.

In an alternative embodiment, the closure lid seating member 15 can be integrally coupled to other internal appurtenance, such as the basket assembly 7. In an alternative embodiment, the closure lid 3 is adapted to be inserted with a drain or vent member 11 and a port cover 5. The closure lid 3 can include a drain or vent passage 10 in which the drain or vent member 11 is disposed. The drain or vent passage 10 is conformed substantially to the shape of the drain or vent member 11. The closure lid 3 further includes port cover recesses 16 that the port cover 5 rests on. The top surface of the port cover 5 is substantially parallel to the top surface 12 of the closure lid 3.

Where the closure lid 3 engages the open end 4 of the canister shell 9, a weld area 8 is provided in the proximity of the outer circumference of the closure lid 3 that meets the weld depth and weld type requirements of both the design and applicable regulations, codes and standards. A first weld layer 17 welds the closure lid 3 to the canister shell 9 at the weld area 8 and closes the canister 1 as a first seal or closure to the canister 1. A second weld layer 19 welds the closure lid 3 to the canister shell 9 at the weld area 8 and closes the canister as second seal or closure to the canister 1. The second weld layer is disposed substantially on top of the first weld layer 17. The first and second weld layers 17, 19 are independent layers and seals for the canister closure. The first and second weld layers 17, 19 are single pass welds or multi-pass welds with interpass temperatures that meet the requirement for the specific material and the welding method or application. In an alternative embodiment, additional redundant weld layers are applied to weld the closure lid 3 to the canister shell 9 at the weld area 8 and close the canister 1 to assure that the composite weld layer depth and/or the number of redundant seal weld layers is achieved The weld layers 17, 19 are achieved using a multiple independent layer, discrete redundant inspection (MILDRI) weld approach, which is used to establish the redundant sealing for the single closure lid canister design. The MILDRI weld process is performed as follows:

1. A welding machine (not shown) designed to lay weld consistent with the canister design and weld configuration is placed in position to perform the weld in the weld area 8.
2. The welding machine provides a first weld layer 17 which is comprised of a root weld. It should be noted that multiple passes may be used to achieve the first weld layer.

3. The first weld layer 17 becomes the first independent layer and first seal for the canister closure by meeting the following acceptance criteria:
   a. The first weld layer 17 has been applied as a single pass weld or as a multi-pass weld with inter-pass temperatures meeting all requirements for the specific materials and welding conditions;
   b. The first weld layer 17 meets the depth requirements that are required by safety or other analysis.
   c. The first weld layer 17 is allowed to cool below some maximum temperature (in the range of the material-specific adhesion temperature) to assure the first weld layer 17 has achieved adhesion characteristics with the canister shell 9 and closure lid 3 that are suitable for independent inspection for cracks and adhesion using approved methods and techniques;
   d. An independent inspection of the first weld layer 17 is performed using approved methods and techniques, such as dye-penetrant examination, to determine the quality of the weld and its acceptability;
   e. Any weld inconsistencies, flaws, or other manifestations of lack of adhesion or weld soundness in the first weld layer 17 are reviewed, accepted, or repaired in accordance with design and procedure acceptance criteria;
   f. Any weld repairs of the first weld layer 17 are further inspected by similar methods to verify repair acceptance in accordance with appropriate acceptance criteria.

Following completion, inspection, and acceptance of the first weld layer 17, a second weld layer 19 is applied in the weld area 8 of the closure lid 3. The second weld layer 19 is in the proximity of the outer circumference of the closure lid 3 where the closure lid 3 engages the open end 4 of the canister shell 9 and is substantially on top of the first weld layer 17. The second weld layer 19 is achieved using similar steps to those in 3*a-f*, as explained above, to assure that the second weld layer 19, independent inspection, and integrity requirements are met to permit the first and second weld layers 17, 19 to serve as redundant seals. In an alternative embodiment, additional weld layers can be applied to assure that the composite weld layer depth and/or the number of redundant seal weld layers is achieved using similar approaches and acceptance criteria as in step 3, explained above.

In an alternative embodiment, a seal ring 2 is disposed above a preceding weld layer and between the canister shell 9 and the closure lid 3. The seal ring 2 is substantially parallel to the top end 14 of the canister 1 and top surface 12 of the closure lid 3. The seal ring is welded to the canister shell and to the closure lid 3 to form two weld surfaces 21, 23. The first and second weld surfaces 21, 23 can be single pass welds or multi-pass welds, with inter-pass temperatures that meet the requirement for the specific material and the welding method or application. The seal ring 2 provides a separate, redundant closure surface, in addition to the closure lid 3 having other weld layers. The seal ring 2 can be of a unit design or of a segmented design to facilitate handling or placement.

It is further depicted in the embodiment of FIG. 2 that the closure lid 3 may be configured with an upper portion having a first lateral outer circumference that laterally intersects the weld area 8 at the bottom of the upper portion of the closure lid 3. The closure lid 3 may further be configured with a lower portion having a second lateral outer circumference that laterally intersects the weld area 8 at or near the top of the lower portion of the closure lid 3 as depicted. A magnitude of the first lateral outer circumference is less than or smaller than the second lateral outer circumference. The lower portion of the closure lid 3 is further positioned at a lower altitude relative to the upper portion of the closure lid 3. The closure lid 3 can further include a middle portion having a variable lateral outer circumference that ranges from the first lateral outer circumference to the second lateral outer circumference. In other words, as depicted in the drawing, the upper portion, middle portion, and bottom portion of the closure lid 3 create a cavity that makes up the depicted weld area 8. The weld area 8 is accordingly between the closure lid 3 and canister shell 9 at or near the top of the bottom portion of the closure lid 3 and below the bottom of the upper portion of the closure lid 3.

The root welds 21, 23 of the seal ring 2 are achieved using the MILDRI weld process as mentioned above in reference to the weld layers 17, 19. It should be noted that single pass or multi-pass welds can be applied to assure that the composite weld depth is achieved. It should also be noted that the weld surfaces 21, 23 can have multiple weld layers.

Figure 3A:
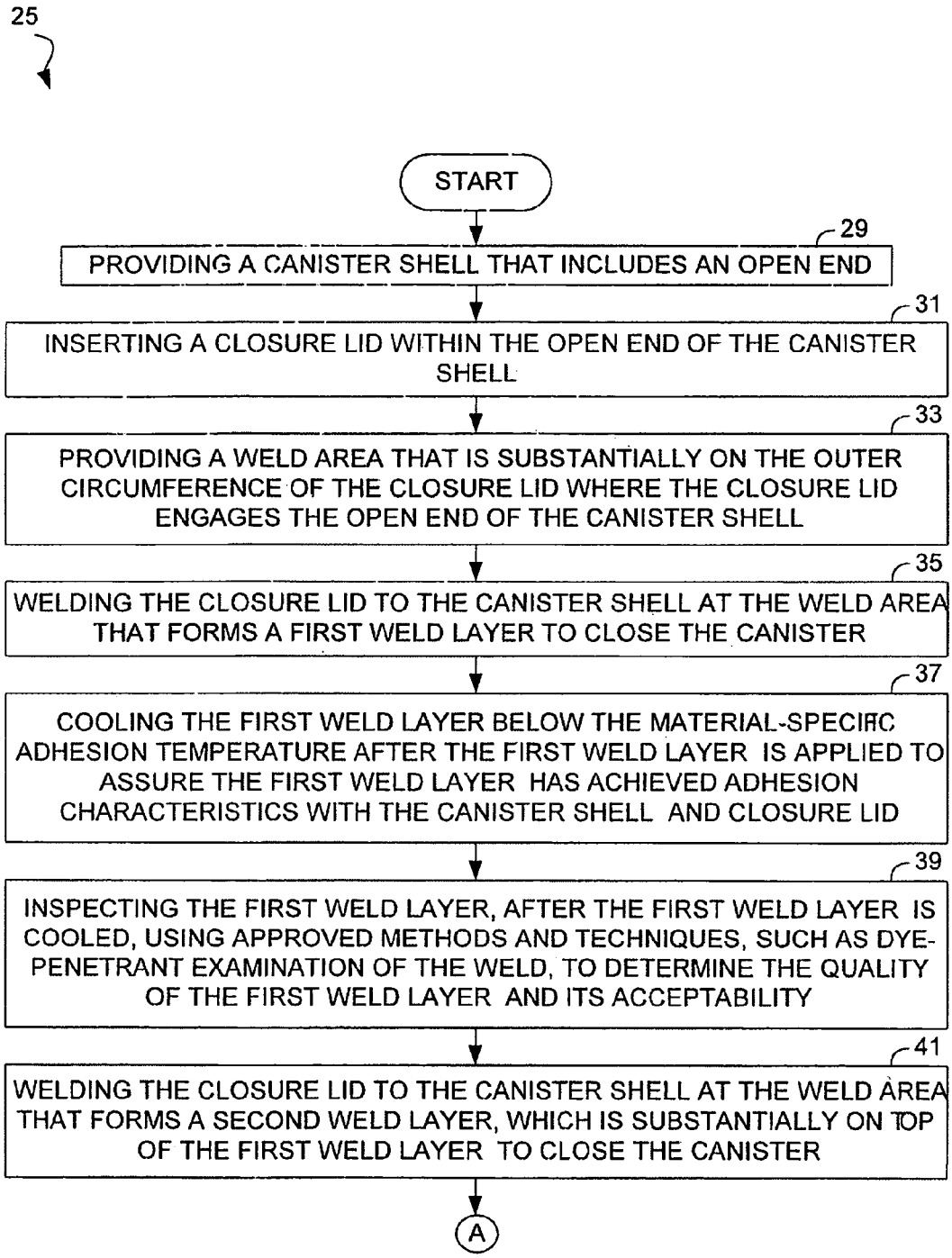
FIGS. 3A-C are flow diagrams that illustrate an embodiment of operation of closing the canister with a single lid having redundant seals shown in FIGS. 1 and 2.
Figure 3B:
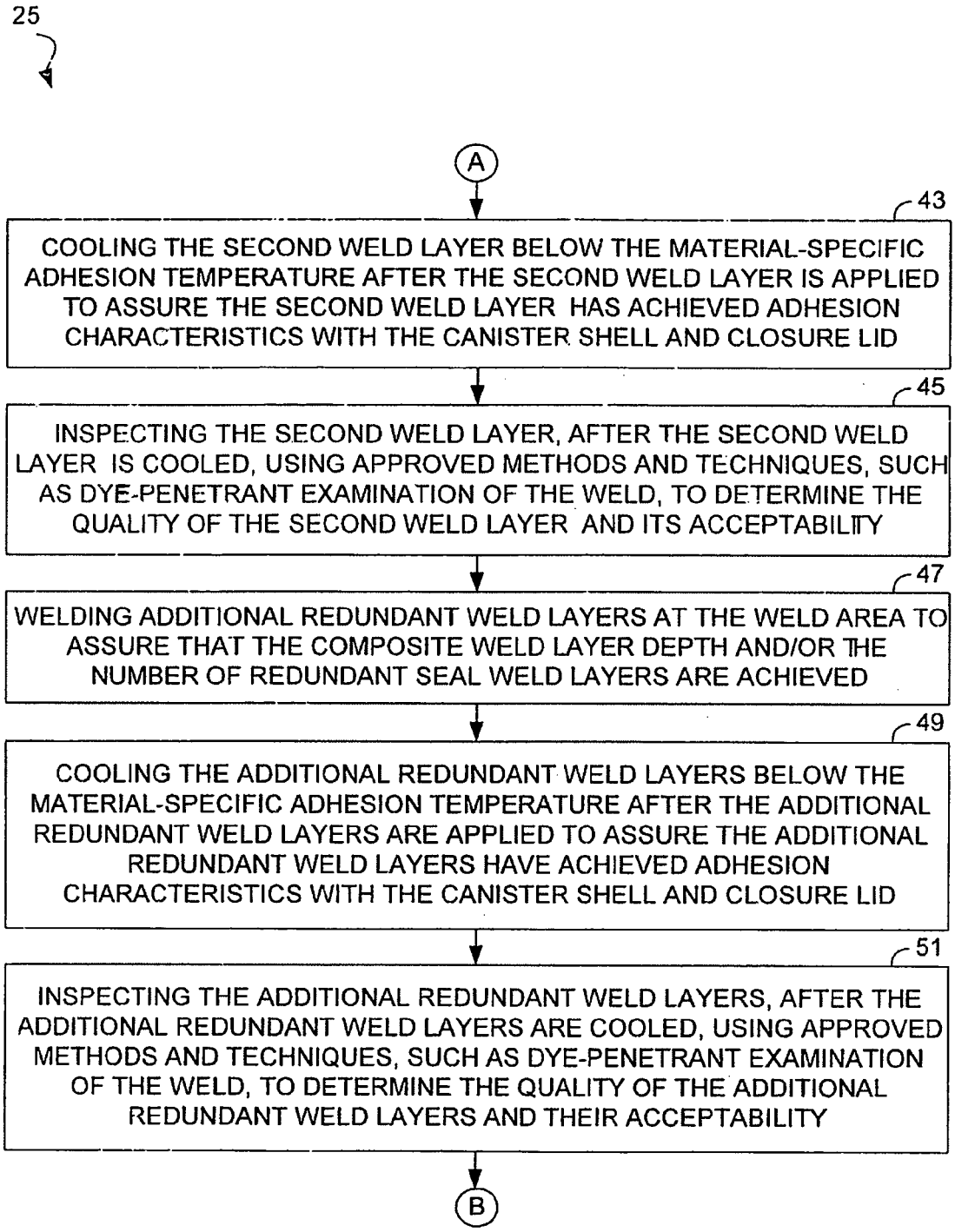
Figure 3C:
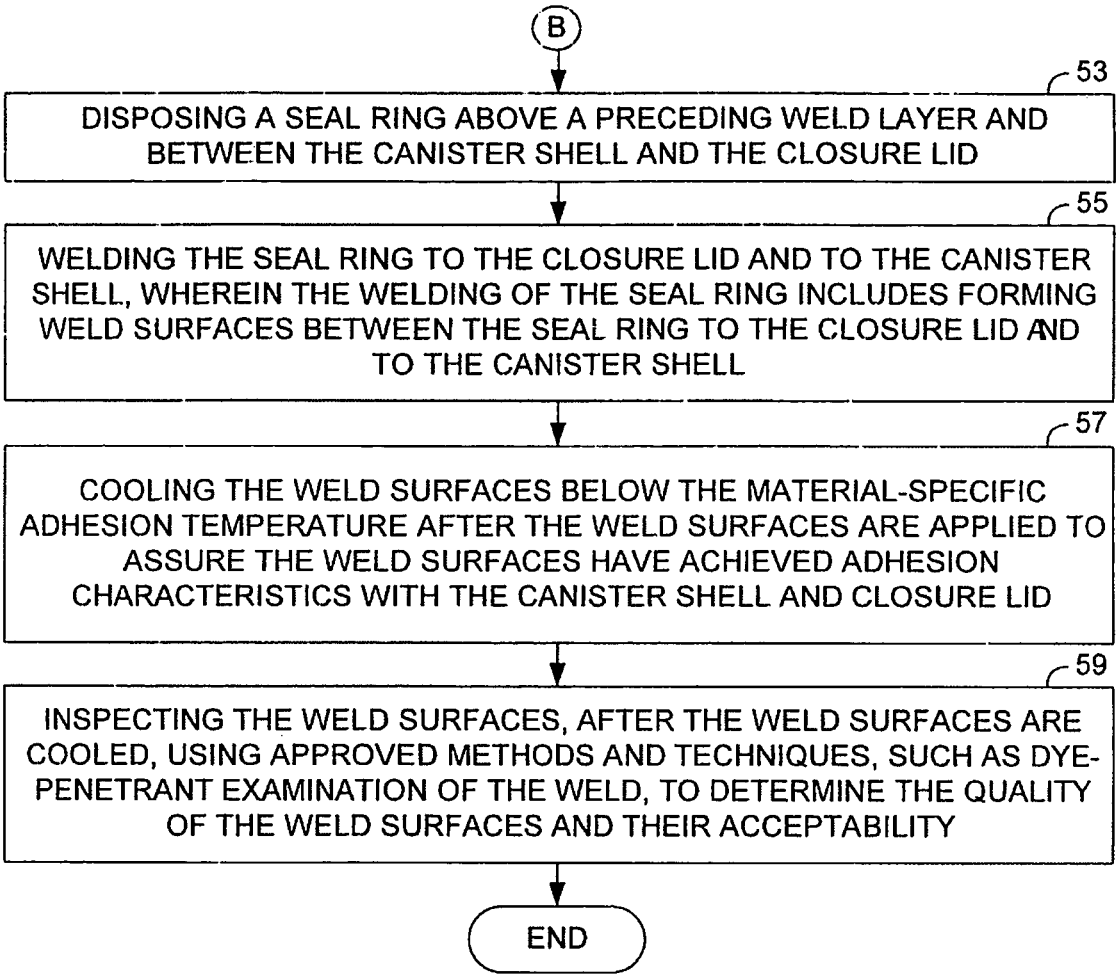

FIGS. 3A-C are flow diagrams that illustrate an embodiment of operation of closing the canister with a single lid having redundant seals shown in FIGS. 1 and 2. Referring now to FIG. 3A, in block 29, the method 25 for closing the canister 1 includes providing a canister shell 9 that includes an open end 4. In block 31, a closure lid 3 is inserted within the open end 4 of the canister shell 9. It should be noted that a basket assembly can be inserted into the canister before the closure lid 3 is inserted within the open end 4 of the canister shell 9. In block 33, a weld area 8 is provided that is substantially on the outer circumference of the closure lid 3 where the closure lid 3 engages the open end 4 of the canister shell 9.

In block 35, the closure lid 3 is welded to the canister shell 9 at the weld area 8 that forms a first weld layer 17 to close the canister 1. In block 37, the first weld layer 17 is cooled below the material-specific adhesion temperature after the first weld layer 17 is applied to assure the first weld layer 17 has achieved adhesion characteristics with the canister shell 9 and closure lid 3. In block 39, the first weld layer 17 is inspected, after the first weld layer 17 is cooled, using approved methods and techniques, such as dye-penetrant examination of the weld, to determine the quality of the first weld layer 17 and its acceptability. In block 41, the closure lid 3 is welded to the canister shell 9 at the weld area 8 that forms a second weld layer 19, which is substantially on top of the first weld layer 17 to close the canister 1.

Referring now to reference A in FIG. 3B, blocks 43 and 45 repeat steps 37 and 39 for the second weld layer 19. In block 47, additional redundant weld layers are welded at the weld area 8 to assure that the composite weld layer depth and/or the number of redundant seal weld layers are achieved. Blocks 49 and 51 repeat steps 37 and 39 for the additional weld layers. Referring now to reference B in FIG. 3C, in block 53, a seal ring is disposed above a preceding weld layer and between the canister shell 9 and the closure lid 3. In block 55, the seal ring 2 is welded to the closure lid 3 and to the canister shell 9. The welding of the seal ring 2 includes forming weld surfaces 21, 23 between the seal ring 2 to the canister shell 9 and to the closure lid 3. Weld surfaces 21, 23 can be single pass or multi-pass welds. Blocks 57 and 59 repeat steps 37 and 39 for the weld surfaces 21, 23.

It should be emphasized that the above-described embodiments of the present invention, particularly, any "preferred" embodiments, are merely possible examples of implementations, set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A canister that is capable of storing and transporting spent nuclear fuel, the canister comprising:

a canister shell that includes an open end;

a closure lid that is inserted within the open end of the canister shell, the closure lid having a sidewall, an upper portion having a first outer lateral circumference and a lower portion having a second outer lateral circumference, the first outer lateral circumference less than the second outer later circumference;

a first weld layer disposed in a weld area, the first weld layer having welds between the closure lid and the canister shell at the top of the lower portion of the closure lid, the first weld layer being configured to close the closure lid onto the canister as a first seal to the canister;

a second weld layer disposed above the first weld layer, the second weld layer having welds between the closure lid and the canister shell and disposed on the first weld layer, the second weld layer being configured to close the closure lid onto the canister as a second seal to the canister; and a seal ring that is disposed above the second weld layer and between the canister shell and the upper outer circumference of the sidewall of the canister lid, a lower portion of the seal ring being placed substantially adjacent to the second weld layer, a top surface of the seal ring being substantially aligned and welded to the top surface of the closure lid and a top end of the canister shell, the seal ring being configured to close the closure lid onto the canister as a second seal to the canister.

2. The canister as defined in claim 1, wherein the at first weld layer and the second weld layer have a composite weld layer depth to assure closure of the canister.

3. The canister as defined in claim 1, further comprising a basket assembly that is disposed in the canister shell.

4. The canister as defined in claim 2, wherein the first weld layer and second weld layer are cooled below a material-specific adhesion temperature after the each of the weld layers are applied to assure each of the weld layers has achieved adhesion between the canister shell and closure lid.

5. The canister as defined in claim 4, wherein the first weld layer and second weld layer are inspected after a prescribed number of weld passes is cooled using approved methods and techniques to determine the quality of the weld layers and their acceptability, the approved methods and techniques including a dye-penetrant examination.

6. The canister as defined in claim 1, further comprising weld surfaces that weld the seal ring to the closure lid and to the canister shell.

7. The canister as defined in claim 6, wherein weld surfaces are applied as single pass welds or multi-pass welds.

8. The canister as defined in claim 6, wherein the weld surfaces are cooled below a material-specific adhesion temperature after the weld surfaces are applied to assure the weld surfaces have achieved adhesion among the seal ring, canister shell and closure lid.

9. The canister as defined in claim 8, wherein the weld surfaces are inspected after the weld surfaces are cooled using approved methods and techniques to determine the quality of the weld surfaces and their acceptability, the approved methods and techniques including a dye-penetrant examination.

* * * * *